United States Patent [19]

Eppensteiner et al.

[11] 3,972,789

[45] Aug. 3, 1976

[54] ALKALINE BRIGHT ZINC PLATING AND ADDITIVE COMPOSITION THEREFORE

[75] Inventors: Frederick W. Eppensteiner, Southfield, Mich.; Phillip J. DeChristopher, Chicago, Ill.

[73] Assignee: The Richardson Company, Des Plaines, Ill.

[22] Filed: Feb. 10, 1975

[21] Appl. No.: 548,242

[52] U.S. Cl. ..... 204/55 Y; 204/DIG. 2; 204/55 R; 260/2 EP; 260/29.2 EP

[51] Int. Cl.[2] ..... C25D 3/22; C25D 3/24; C08G 65/26

[58] Field of Search ..... 204/55 R, 55 Y, 43 Z, 204/44, DIG. 2; 260/2 EP, 29.2 EP

[56] References Cited

UNITED STATES PATENTS 3,884,774 5/1975 Kessler ..... 204/55 Y

*Primary Examiner*—G. L. Kaplan
*Attorney, Agent, or Firm*—Alan M. Abrams

[57] ABSTRACT

An alkaline, electroplating bath for bright zinc plating containing a composition comprising a condensate of a heterocyclic compound and an epihalohydrin, for example a condensate of nicotinamide and epichlorohydrin or a corresponding quaternary salt of such condensate, which bath is capable of producing bright, fine grained zinc deposits over a broad current density range both in the presence and absence of cyanides.

28 Claims, No Drawings

ALKALINE BRIGHT ZINC PLATING AND ADDITIVE COMPOSITION THEREFORE

This invention relates to bright zinc electroplating or more particularly to electroplating baths for zinc plating containing certain condensates of heterocyclic compounds and epihalohydrins which produce bright, zinc electrodeposits and which, moreover, permit the plating to be conducted with various concentrations of cyanide salts or even desirably in the total absence of such salts.

Zinc electroplating has conventionally been conducted in a plating bath employing alkali metal cyanide salts such as sodium cyanide as an additive or complexing agent to achieve the desired plating operation and particularly to produce bright, smooth grained zinc deposits.

Quite often the brightness and/or grain of the electrodeposit is not entirely suitable for many plating applications and accordingly various additives such as brighteners or grain refiners have been required in the bath in order to enhance the plating. Such additives have not however always been effective in their intended use, and typically they also require high levels of cyanides in order achieve the desired plating. Moreover, because of the toxicity of cyanides and more recently because of the environmental considerations adversely affecting the economic employment of these cyanides other plating methods have been sought which operate effectively either at a low cyanide level or advantageously in the total absence of cyanide salts.

A wide variety of procedures and additives have been suggested for use in zinc plating for the purpose of avoiding cyanides or lessening the concentration required. Many of these employ an alkaline plating bath system utilizing an alkali metal or sodium zincate combined with various additives such as polyamines to achieve the desired bright zinc deposit with a smooth or fine grained, mirror-like surface.

While certain of these alkaline systems do avoid the use of cyanides or at least high bath concentrations of cyanides, they generally have not been overly successful, and the zinc electrodeposits typically produced have a number of deficiencies such as a dull or granular finish which render them of little or poor commercial value. Such systems, moreover, typically lack the desired capability of producing a suitable smooth, mirror-like deposit over a broad current density range and generally are especially ineffective at the lower current density ranges which conventionally occur in many commercial plating operations.

It has now been discovered that a composition comprising a condensate of an epihalohydrin and a heterocyclic compound as well as its corresponding quaternary salt may be employed in alkaline zinc electroplating baths to produce fine grained, bright zinc deposits over a broad current density range both in the presence and absence of cyanide salts.

Accordingly, an objective of this invention is to provide an alkaline, zinc electroplating bath which achieves bright zinc deposits either with various concentrations of cyanide salts or in the total absence of such salts. Another object is to provide such a bath which employs a condensate of an epihalohydrin and a heterocyclic compound such as a nicotinamide or its corresponding quaternized salt and is capable of producing a smooth, fine grained deposit. A further object is to employ such condensate with other conventional plating additives such as brightening agents or grain refiners to achieve bright, mirror-like deposits over a broad current density range. Still another object is to provide a method of zinc electroplating employing such improved bath and capable of effectively operating in a commercially desirable manner both with and without cyanide salts. These and other objects of this invention will be apparent from the following further detailed description thereof.

The electroplating of zinc in an aqueous alkaline bath is effected in accordance with this invention by adding a composition comprising a condensate of a heterocyclic compound and an epihalohydrin or a corresponding quaternary salt of such condensate to such bath so as to obtain smooth, fine grained deposits. In general, these condensates are produced by reacting the heterocyclic compound and the epihalohydrin in a suitable condensation reaction to produce an aqueous or water-soluble condensate product. In accordance with this invention the condensate may also be employed as a quaternary salt and the preparation of such salt basically involves a further reaction of the condensate with a suitable quaternizing agent.

The epihalohydrin which may be interreacted with the heterocyclic compound includes epichlorohydrin, epibromohydrin or epiiodohydrin with the epichlorohydrin being particularly preferred in most instances. Other halo epoxies or glycerol halohydrins which reacts in a similar fashion or which form a reaction moiety similar to the epihalohydrin under condensation conditions may also be employed although generally with less desirable results. Such halo epoxides may include halo glycerols such as alpha di-chloroglycerol or epoxy alkanes or di-epoxides such as bis-(2,3-epoxypropane) propylene glycol.

The heterocyclic compound and specifically a nitrogen heterocyclic compound which may be reacted with the epihalohydrin to form the condensate or use in accordance with this invention in bright zinc electroplating baths comprises a heteroyclic, such as pyridine, substituted in the 3 or 4 ring position with a radical selected from the group consisting of amino, carbamoyl or acylhydrazino.

Such pyridine has the following general formula:

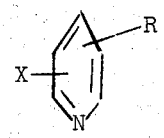

wherein R is a radical selected from the group consisting of amino, ($-NH_2$); carbamoyl,

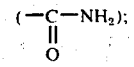

or acylhydrazino,

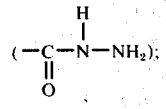

where R is in one of the 3 or 4 ring positions and where X is a radical which does not interfere with the condensation reaction and includes for example lower alkyl of from 1 to 5 carbon atoms, halo such as chloro or bromo; or lower alkoxy of from 1 to about 5 carbon atoms.

Of the various nitrogen heterocyclic compounds which may be employed according to this invention, the pyridines substituted in the 3 ring position are preferred and especially when substituted with carbamoyl to form such compounds as nicotinamide, that is, 3-carbamoyl-pyridine. Other compounds having the above general formula may also be employed and include, for example, such as compounds as 4-carbamoyl-pyridine; 3-amino-pyridine; 4-amino-pyridine; 3-acylhydrazinopyridine; 4-acylhydrazinopyridine; or 3-amino-5-methoxy-pyridine.

In preparing the condensate of the nitrogen heterocyclic and epihalohydrin for use in the zinc baths according to this invention, the conditions and procedures conventionally employed in condensation reactions between epihalohydrins and cyclic amines may, in most instances, be suitably employed. In general, the heterocyclic and epihalohydrin should be condensed in a mol ratio from about 2:1 to 1:2 mols, respectively. Usually a more limited range is preferred, however, particularly when employing preferred reactants such as epichlorohydrin and a nicotinamide and advantageously the mol ratio of the epihalohydrin to heterocyclic compound ranges from about 1.5:1 to 1:1.5 respectively, or more preferably about 1 to 1, respectively.

Typically, the condensation reaction is conducted by gradually adding the epihalohydrin with stirring to the heterocyclic compound maintained in a suitable reaction medium such as water or aqueous alcohol and then permitting the reaction to proceed to completion. The reaction temperature employed may be varied depending upon the particular reactants utilized but usually ranges from above about 25°C or 80°C or 90°C with the reflux temperature of the mixture in the range of approximately 100°C being conveniently employed in most instances. The duration of the condensation reaction may also be varied and is a function of the specific reactants and temperatures employed. Usually, however, the reaction period ranges from about 0.5 to 2.0 hours when utilizing such reactants as epichlorohydrin and nicotinamide.

Upon completion of the condensation reaction the product may, if desired, be separated from the reaction mixture using conventional separational techniques such as distillation and/or filtration to recover the desired product. Conveniently, however, and particularly when employing an aqueous reaction medium the condensation product need not be separated from the reaction mixture and the final reaction mixture containing the condensate product may be directly employed as an additive to the zinc plating bath.

The condensate product obtained in the condensation reaction may generally be characterized as a water soluble polyamide having carbonyl functionality and a macromolecular or polymeric nature. For example, in a condensation employing a epihalohydrin and a heterocyclic such as nicotinamide the condensate product, in simplest illustrative form may be characterized by the following basic repeating unit.

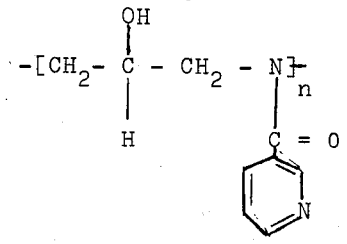

where $n$ ranges from about 1.5 to 30 or more and usually corresponds to a molecular weight of from about 400 to 9000 or more preferably from about 200 to 3000. Such condensate product is crystalline in nature, highly hygroscopic and generally absorbs moisture quickly and dissolve with the general characteristics of a polyelectrolyte. Such condensate moreover is highly water soluble and generally quite stable in highly alkaline media thus rendering such condensate particularly suitable for employement in bright zinc electroplating baths.

As indicated the polymeric condensate may also be employed in the zinc electroplating bath of this invention in the form of a quaternary salt. In general these quaternary salts may be prepared by quaternizing the condensate of the heterocyclic compound and epihalohydrin as prepared according to the procedures described above by further reacting the condenate thus prepared with a suitable quaternizing agent. Typically the condensate in the form of a quaternary salt may be represented in a illustrative structure which corresponds to the structure above for the condensate of epichlorohydrin and nicotinamide as follows:

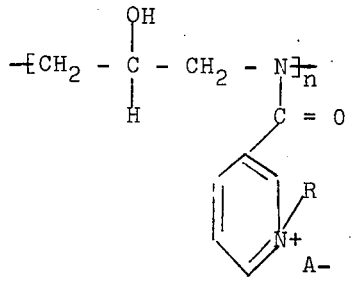

where R is the quaternizing group of the quaternizing agent and A is mono or polyvalent anion derived from the quaternizing agent.

Suitable quaternizing agents for reaction with the condensate include the lower alkyl or alkenyl halides such as methylchloride, -bromide, or -iodide; ethylchloride, -bromide- or -iodide; or alpha chloroglycerol; diloweralkyl sulfates such as dimethyl-, diethyl-, dipropyl-, or dibutyl-sulfates; aralkyl halides such as benzyl chloride; lower alkyl esters of aryl sulfonates such as methyl toluene sulfonate and methyl benzene sulfonate; alkylhalo esters such as ethyl-chloroacetate; alkylene halohydrins such as ethylenechlorohydrin or alkylene oxides such as ethylene oxide or propylene oxide; alpha halo acetic acid derivatives for example alpha chloro ethyl acetate, alpha chloro acetamide, alpha chloro sodium acetate; haloketones such as chloroacetone; lactones for example propiolactone or sultones such as propane sultone.

The quaternization of the condensate of the heterocyclic compound and the epihalohydrin such as nicotinamide and epihalohydrin for use in accordance with this invention may be effected according to conventional procedures. In general the condensate is reacted with the desired quaternizing agent at a temperature of from about 25° to about 75°C and for a few minutes to several hours in a suitable reaction medium. Advantageously such reaction medium may be the final reaction mixture of the condensation reaction and the desired quantity of the quaternizing agent may be directly added to such mixture to effect the desired quaternization of the condensate. Generally, the desired quaternizing agent should be added to the condensate in a ratio of from about 0.5 to 1.0 mols of quaternizing agent per mol of condensate with about 1 mol being preferred in most instances. After the reaction is completed the quaternary salt may, if desired, be recovered from the reaction mixture utilizing suitable separating techniques. However, as with the condensate, the water soluble quaternary salt need not be separated from the reaction mixture and may conveniently be directly added to the zinc plating bath while still contained in the reaction mixture.

The electroplating bath of this invention may be prepared and operated in accordance with the general procedures conventionally employed for alkaline, bright zinc plating. Typically, the bath is prepared as an aqueous solution and rendered alkaline by the addition of a suitable alkaline material such as alkali metal hydroxide for example sodium or potassium hydroxide. The condensate or quaternized condensate is then usually added as an aqueous concentrate. The quantity of alkaline material added should be capable of dissolving the zinc compound employed as the source of the zinc ion in the bath and generally should be in excess of that required to create in certain baths a desired alkali metal zincate such as sodium zincate as well as to maintain the pH of the solution alkaline and generally above 7 and preferably above 14 which corresponds to a sodium hydroxide concentration of from about 50 to 120 grams per liter.

The source of the zinc ion in the bath can be varied and generally any of the zinc compounds conventionally employed in alkaline bright zinc baths may be utilized. Typically such compounds include water soluble or aqueous alkaline soluble, zinc salts or oxides such as zinc sulfate, zinc acetate or zinc oxide with the zinc sulfate generally being preferred for cyanide free baths and zinc oxide for cyanide containing baths. The amount of zinc in the bath can be varied depending upon the desired results and operating conditions but usually is maintained within the range of from about 1 to about 55 grams per liter with a more limited range of about 3 to 35 grams per liter being more typical.

The amount of the condensate of the heterocyclic compound and epihalohydrin or the quaternary salt of such condensate utilized in the bath of this invention will in general be a function of the particular condensate or quaternized condensate employed as well as whether the bath is operated with or free of cyanides. Typically however, when employing condensates of such heterocyclic compounds as nicotinamide and such epihalohydrins as epichlorohydrin, the quantity of the condensate or quaternized condensate in the bath should range from about 0.001 to about 1.0 grams per liter with a more limited range of from about .009 to about 0.5 grams per liter usually being preferred when using the quaternized condensates and a range of from about 0.02 to about 1.0 when using the unquaternized condensates.

When the bath of this invention is operated in the presence of cyanide salts, such salts may include any of the salts or equivalent sources or cyanide ions conventionally used in zinc cyanide plating. Typically such cyanide salt is an alkali metal cyanide such as sodium or potassium cyanide. The quantity of the cyanide salt present in the bath may range from about 2 to about 200 grams per liter with a more limited and lower range of from about 8 to about 130 grams per liter generally be preferred for most applications.

As indicated the bath of this invention may be operated either with or without cyanide ions. Typically when operated with cyanides, the condensate or quaternized condensate of this invention serves to act as a brightener and may be employed as a replacement for or as a supplement to the conventional brighteners used in zinc electroplating baths. When operating without or in the absences of cyanides, the condensate or quaternized condensate serves to act as a grain refiner for the electroplate and when combined with brighteners produces fine grained, mirror bright, zinc electrodeposits.

The plating bath of this invention may contain other additives of the type conventionally employed in alkaline zinc electroplating baths and include such materials as brightening agents such as aldehydes, grain refiners such as polyamines, gelatine, glues, peptone or polyvinyl alcohols.

The brighteners which may be used for such purpose are those materials conventionally employed in zinc plating and include metals such as manganese or nickel or organic aldehyde type compounds. Such organic aldehydes contain a carbonyl group of aldehyde functionality and generally may be represented by the formula:

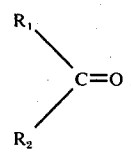

wherein $R_1$ and $R_2$ are independently selected from the group consisting of hydrogen, alkyl of generally 1 to about 10 carbon atoms, aryl and heterocyclic oxygen and sulfur containing radicals and include, for example, m-hydroxy benzaldehyde, p-hydroxy benzaldehyde, piperonal, o-hydroxy benzaldehyde (salicylaldehyde), veratraldehyde, benzaldehyde, β-methoxy propinaldehyde, furfural, glyceraldehyde, anisaldehyde, vanillin, or thiophene-2-aldehyde.

Of the various aldehyde materials which may be employed the aryl aldehydes and particularly the benzaldehydes such as anisic aldehyde (p-methoxybenzaldehyde) or vanillin (p-hydroxy-m-methoxybenzaldehyde) or various combinations thereof are preferred. If desired the aldehyde brighteners may be employed in the bath of this invention as addition products with such materials as sodium bisulfite to increase their alkaline solubility.

The aldehyde brighteners used in combination with the condensate or quaternized condensate usually will be present in the bath within the ranges conventionally utilized for alkaline zinc plating baths. Typically this will range from about 0.05 to about 5 grams per liter with a more limited range from about 0.2 to about 0.5 grams per liter being more advantageously employed particularly when utilizing the preferred benzaldehyde type brighteners.

Polyvinyl alcohols are also particularly suitable for use in the baths of this invention especially to enhance the obtainment of a mirror-like finish for the electrodeposits of this invention. When so employed these polyvinyl alchols should be utilized in the bath within a range of from about 0.001 to about 0.5 grams per liter.

The electroplating of zinc conducted in accordance with the process of this invention is effected in conventional fashion basically by passing a direct current from a zinc anode through the aqueous alkaline, bath of this invention, containing essentially the condensate or quaternary salt thereof, zinc ions, cyanide ions if used and other additives such as brighteners and grain refiners, to the desired cathode article which is to be electroplated with the zinc. This process may be conducted at temperatures from about 10° to about 100°C or more typically about 15° to 45°C. The current densities employed may range from above about 0 to about 200 amperes per square foot with a more limited range of from about 1.0 to about 120 amperes per square foot being satisfactory for most plating operations.

The following examples are offered to illustrate the plating bath and electroplating methods of this invention.

EXAMPLE I

The condensate and corresponding quaternary salts of the type employable in the electroplating baths of this invention may be prepared as follows:

A. Condensation

Into a four-liter, four-neck flask equipped with a mechanical stirrer, dropping funnel, thermometer, condenser, and heating mantle were placed 366.4 grams (3 mols) of nicotinamide and about 2 liters of de-ionized water. This mixture was stirred and heated to about 97°C, and 277.6 grams (3 mols) of epichlorohydrin were added drop wise over a 0.5 hour period, while maintaining the reaction mixture under total reflux at about 100°C. The mixture was then heated for another 1 to 1.5 hours at about 97°–100 C and thereafter cooled to recover a clear, dark reddish-brown, aqueous mixture containing the soluble condensate product having a final pH in the range of 5 to 7.

B. Quaternization

Into a two-liter, four-neck flask (equipped with a condenser, thermometer, heating mantle, stirrer, and two dropping funnels connected to a Claisen adaptor) were added approximately 885 grams of the aqueous condensate product mixture as prepared in A above which contained the equivalent of about 1.0 mol of the condensate. While stirring, the aqueous mixture was heated to about 50°C and maintained at such temperature. Then with continuous stirring, 80 grams of aqueous sodium hydroxide (50 weight percent) and 126.1 grams of dimethyl sulfate were added simultaneously in a dropwise manner over about a one hour period. The rates of simultaneous addition were adjusted so as to maintain a pH of about 9. The mol ratio of condensate: sodium hydroxide: dialkyl sulfate was 1.0:1.0:1.0, respectively. When the addition were complete, the reaction mixture was heated for an additional three to four hours. The final quaternized condensate product mixture obtained was clear, with a dark reddish brown color and a pH of about 7 to 9.

EXAMPLE II

A series of zinc electroplatings were conducted in various aqueous alkaline cyanide and non-cyanide electroplating baths to zinc plate steel Hull cell test panels. The plating was carried out in a standard Hull cell (267 ml.) with the Hull cell panel in each test connected as the cathode and with a 99.99 percent high purity zinc metal bar used as the anode. The plating was conducted at a total operating current of 1.0 ampere which represents a current density range on the test panel varying from a high range of from about 40 to 100 amperes per square foot (a.s.f.) to a low range of about 0.1 to about 0.5 (a.s.f.). The plating time was 10 minutes and the bath was operated about 75°F. In each test a bath was prepared with the various components admixed and then employed to plate the test samples. The components of the various plating baths are summarized in Table I with the results summarized in Table II.

TABLE I

| TEST RUN | COMPONENT CONCENTRATIONS IN GRAMS/LITER | | | | | | | | |
|---|---|---|---|---|---|---|---|---|---|
| | A | B | C | D | E | F | G | H | I |
| 1 | 33.8[1] | 93.75 | 78.0 | — | — | — | — | — | — |
| 2 | 33.8[1] | 93.75 | 78.0 | 0.082 | — | — | — | — | — |
| 3 | 33.8[1] | 93.75 | 78.0 | 0.082 | — | 0.018 | — | — | — |
| 4 | 33.8[1] | 93.75 | 78.0 | 0.082 | — | 0.018 | 0.002 | — | — |
| 5 | 7.5[2] | 15.0 | 75.0 | — | — | — | — | — | — |
| 6 | 7.5[2] | 15.0 | 75.0 | 0.082 | — | — | — | — | — |
| 7 | 7.5[2] | 15.0 | 75.0 | 0.082 | — | 0.018 | — | — | — |
| 8 | 7.5[2] | 15.0 | 75.0 | 0.082 | — | 0.018 | 0.002 | — | — |
| 9 | 7.5[3] | — | 93.75 | — | — | — | — | — | — |
| 10 | 7.5[3] | — | 93.75 | — | 0.59 | — | — | — | — |
| 11 | 7.5[3] | — | 93.75 | 0.59 | — | — | — | — | — |
| 12 | 7.5[3] | — | 93.75 | — | 0.59 | 0.12 | — | — | — |
| 13 | 7.5[3] | — | 93.75 | — | 0.59 | 0.12 | — | 0.60 | — |
| 14 | 7.5[3] | — | 93.75 | — | 0.59 | 0.12 | — | 0.60 | 0.40 |
| 15 | 7.5[3] | — | 93.75 | 0.082 | — | — | — | — | — |
| 16 | 7.5[3] | — | 93.75 | — | 0.082 | — | — | — | — |

[1]as zinc cyanide;
[2]as zinc oxide;
[3]as zinc sulfate.

BATH COMPONENTS

A = Zinc metal
B = Sodium cyanide
C = Sodium hydroxide
D = Quaternized condensate of Example IB
E = Condensate of Example IA
F = Polyvinyl alcohol
G = Metallic brightener (e.g., $MnCl_2$ or $NiCl_2$ )
H = Adduct of anisic aldehyde with sodium bisulfite
I = Vanillin
J = Quaternized aliphatic polyamine as prepared by procedures of U.S. 3,642,663

TABLE II

| TEST RUN | PLATING RESULTS |
|---|---|
| 1 | Grain refined, but dull to semi bright |
| 2 | Grain refined with bright finish |
| 3 | Grain refined with mirror like finish |
| 4 | Grain refined with mirror like finish |
| 5 | Same as test 1 |
| 6 | Same as test 2 |
| 7 | Same as test 3 |
| 8 | Same as test 4 |
| 9 | Dark grey to black, non-adherent zinc coating over entire current density range. |
| 10 | Grain refined and adherent edge to edge; smooth and matte grey 0–5 a.s.f; smooth and bright 5–25 a.s.f.; matte and coarse 25 a.s.f. to the high current edge |
| 11 | Similar to test 10, adherent, but less optimal: matte grey and smooth 0–8 a.s.f.; bright and coarse 9–15 a.s.f; and dull grey 15–60 a.s.f. |
| 12 | Smooth, bright and adherent 0–40 a.s.f; hazy 0–4 a.s.f. |
| 13 | Smooth, bright and adherent 0–40 a.s.f; matte hazy 0–6 a.s.f. |
| 14 | Grain refined and bright with luster 0–50 a.s.f. |
| 15 | Grain refined, bright, edge to edge; generally the same as test 14, but lacks high luster. |
| 16 | Same as test 15 |

The plating results summarized in Table II illustrate that the condensate and quaternary salt of such condensate used in accordance with the procedures of this invention improve the plating ability of the bath and can be successfully utilized in both cyanide and cyanide free alkaline zinc electroplating baths.

Compare for example, Test 9 with Tests 10 or 11. In test 9 without cyanide the deposit produced was of no value being both dark and non-adherent while in Tests Nos. 10 and 11 the use of the condensate and quaternized salt produced a thoroughly grain refined and partially brightened plate deposit. Such deposit moreover may be further improved by use of other known additives such as polyvinyl alcohol (Test 12) or aldehydes (see Tests 13 and 14). However use of the latter conventional additives alone without the condensate of this invention, which serve in part as grain refiners in cyanide-free baths do not produce acceptable deposits. Moreover the condensate of this invention, when used in association with grain refiners such as aliphatic polyamines can also be used in non-cyanide, zinc baths as primary brightening additives as illustrated by Tests 15 and 16.

We claim:

1. A bright zinc, electroplating bath comprising an aqueous alkaline solution containing a source of zinc ions and from about 0.001 to about 1.0 grams per liter of a composition selected from the group consisting of a condensate of a heterocyclic compound and an epihalohydrin and the quaternary salt of such condensate wherein the mol ratio of heterocyclic compound to epihalohydrin ranges from about 2:1 to 1:2, said condensate having a molecular weight of from about 400 to 9000, said heterocyclic compound being a pyridine substituted in the 3 or 4 position with a radical selected from the group consisting of carbamoyl and acylhydrazino.

2. The bath of claim 1 wherein the heterocyclic compound is nicotinamide.

3. The bath of claim 2 wherein the mol ratio of nicotinamide to epihalohydrin ranges from about 1.5:1 to about 1:1.5, respectively.

4. The bath of claim 2 wherein the condensate is a condensate of epichlorohydrin and nicotinamide.

5. The bath of claim 1 wherein the composition is a quaternary salt of the condensate of a nicotinamide and a epihalohydrin and the mol ratio of the nicotinamide to epihalohydrin ranges from about 2:1 to 1:2, respectively.

6. The bath of claim 5 wherein the mol ratio of nicotinamide to epihalohydrin ranges from about 1.5:1 to about 1:1.5, respectively.

7. The bath of claim 5 wherein the composition is a quaternary salt of a condensate of nicotinamide and epichlorohydrin.

8. The bath of claim 5 wherein the quaternary salt is formed by reacting the condensate with a quaternizing agent in a mol ratio of from about 0.5 to 1 mols of quaternizing agent per mol of condensate.

9. The bath of claim 1 wherein the molecular weight ranges from about 2000 to 3000.

10. The bath of claim 1 wherein the condensate is present within the range of from about 0.02 to about 1.0 grams per liter.

11. The bath of claim 1 wherein the quaternary salt of the condensate is present within the range of about 0.009 to about 0.5 grams per liter.

12. The bath of claim 1 wherein the bath contains a source of cyanide ions.

13. The plating bath of claim 12 wherein the source of cyanide is sodium cyanide.

14. The bath of claim 12 wherein the cyanide is present as a salt within the range of from about 2 to about 200 grams per liter.

15. The bath of claim 1 wherein the bath is free of cyanide ions.

16. The bath of claim 1 wherein the bath contains a brightener in addition to said composition.

17. The bath of claim 16 wherein the brightener is an organic aldehyde or metal.

18. The bath of claim 1 wherein the bath contains a grain refiner in addition to said composition.

19. The bath of claim 1 wherein the source of zinc ions is an aqueous soluble zinc salt or oxide.

20. The bath of claim 19 wherein the source of zinc ions is zinc sulfate or zinc oxide.

21. The bath of claim 1 wherein the bath contains a polyvinyl alcohol.

22. The plating bath of claim 1 wherein the pH is above 14.

23. A process for the electroplating of zinc which comprises effecting the electroplating within the bath of claim 1.

24. The process of claim 23 wherein the plating is effected free of any cyanide ions.

25. The process of claim 23 wherein the plating is effected in the presence of cyanide ions.

26. The process of claim 23 wherein the bath contains cyanide as a salt within the range of from about 2 to about 160 grams per liter.

27. The process of claim 23 wherein the plating is conducted at a temperature of from about 10° to about 100°C and at a current density ranging to about 200 amperes per square foot.

28. An aqueous concentrate for preparing the bath of claim 1 containing a composition selected from the group consisting of a condensate of a heterocyclic compound and a epihalohydrin and the quaternary salt of such condensate wherein the mol ratio of heterocyclic compound to epihalohydrin ranges from about 2:1 to 1:2, said condensate having a molecular weight of from about 400 to 9000, said heterocyclic compound being a pyridine substituted in the 3 or 4 position with a radical selected from the group consisting of carbamoyl and acylhydrazino.

* * * * *

UNITED STATES PATENT AND TRADEMARK OFFICE

CERTIFICATE OF CORRECTION

PATENT NO. : 3,972,789

DATED : August 3, 1976

INVENTOR(S) : Frederick W. Eppensteiner et al.

It is certified that error appears in the above-identified patent and that said Letters Patent are hereby corrected as shown below:

Column 2, line 39, "or" should read --for--
Column 4, line 12, "200" should read --2000--
Column 4, line 19, "employement" should read --employment--
Column 4, line 27, "condenate" should read --condensate--
Column 6, line 1, "or" should be --of--
Column 8, line 10, "While" should read --With--

In Table I, after column "I" the following column should be added:

| J |
|---|
| - |
| - |
| - |
| - |
| - |
| - |
| - |
| - |
| - |
| - |
| - |
| - |
| - |
| 0.58 |
| 0.58 |

Signed and Sealed this

Twelfth Day of April 1977

[SEAL]

*Attest:*

RUTH C. MASON
*Attesting Officer*

C. MARSHALL DANN
*Commissioner of Patents and Trademarks*

UNITED STATES PATENT AND TRADEMARK OFFICE

CERTIFICATE OF CORRECTION

PATENT NO. : 3,972,789

DATED : August 3, 1976

INVENTOR(S) : Frederick W. Eppensteiner et al.

It is certified that error appears in the above-identified patent and that said Letters Patent are hereby corrected as shown below:

Column 2, line 41, "heteroyclic" should read --heterocyclic--
Column 3, line 41, "25°C or 80°C" should read --25°C to 80°C--
Column 4, line 15, "dissolve" should read --dissolves--
Column 5, line 61, "grams" should read --gram--
Column 5, line 63, "grams" should read --gram--

Column 6, line 48, "m-hydroxy benzaldehyde, p-hydroxy benzaldehyde" should read --m-hydroxybenzaldehyde, p-hydroxybenzaldehyde--
Column 6, line 49, "o-hydroxy benzaldehyde" should read --o-hydroxybenzaldehyde--
Column 6, line 50, "B-methoxy propinalde-" should read --B-methoxypropionalde- --
Column 6, line 68, "grams" should read --gram--
Column 7, line 39,"drop wise" should read --dropwise--
Column 7, line 42, "97°-100 C" should read --97°-100°C--
Column 8, lines 18-23, these lines are unnecessarily emphasized Signed and Sealed this

*Thirteenth* Day of *March 1979*

[SEAL]

*Attest:*

RUTH C. MASON
*Attesting Officer*

DONALD W. BANNER
*Commissioner of Patents and Trademarks*